United States Patent [19]

Grimmer et al.

[11] 4,232,997

[45] Nov. 11, 1980

[54] METHOD AND APPARATUS FOR CONTROLLING COMPRESSORS

[75] Inventors: John E. Grimmer, Franklin; Robert L. Donahue, Indianapolis, both of Ind.

[73] Assignee: Grimmer Schmidt Corp., Franklin, Ind.

[21] Appl. No.: 900,426

[22] Filed: Apr. 27, 1978

[51] Int. Cl.[3] ..... F04B 49/02

[52] U.S. Cl. ..... 417/4; 417/26; 417/28; 417/34

[58] Field of Search ..... 417/26, 28, 34, 288, 417/298, 32, 34

[56] References Cited

U.S. PATENT DOCUMENTS

| | | | |
|---|---|---|---|
| 1,692,266 | 11/1928 | Holdsworth | 417/28 |
| 1,692,269 | 11/1928 | Osgood | 417/34 |
| 1,756,137 | 4/1930 | Saharoof | 417/28 |
| 1,834,593 | 12/1931 | Holdsworth | 418/28 |
| 1,998,265 | 4/1935 | Aikman | 417/34 |
| 2,476,048 | 7/1949 | Lamberton | 417/27 |
| 2,626,099 | 1/1953 | Ashley | 417/298 |
| 3,335,738 | 8/1967 | Christensen et al. | 417/288 |

FOREIGN PATENT DOCUMENTS

| | | | |
|---|---|---|---|
| 542445 | 1/1931 | Fed. Rep. of Germany | 417/34 |

*Primary Examiner*—William L. Freeh
*Attorney, Agent, or Firm*—Ancel W. Lewis, Jr.

[57] ABSTRACT

A method and apparatus for controlling a compressor is disclosed wherein both the compressed air output and the speed of the compressor are simultaneously adjusted in relation to compressed air demand over a wide range of air demands and in a way so as to use less input energy during below-peak demand and automatically return the compressor to an operating condition of minimum speed and minimum power input when there is no demand on the compressor. A reciprocating piston compressor with at least two, and typically more than two, compression chambers driven by a prime mover has a separate unloader device for each compression chamber. A control assembly is responsive to tank pressures indicating demand on the compressor with the movement of one movable control member simultaneously operating both a control valve adapted for successively operating each of the unloader devices one at a time and a speed regulating member for the prime mover. Receiver tank pressure is used to pressurize the unloader devices via the control valve and also move the movable control member to decrease compressor speed as each compression chamber is successively unloaded to not compress air and conversely to increase compressor speed and compressor output to restore tank pressure as demand increases. A pressure regulator adjusts the movable control member by sensing the tank pressure when a selected maximum tank pressure is reached and at that time the movable control member is automatically returned to a position to a minimum speed and minimum power input operating condition for the compressor air demand.

21 Claims, 7 Drawing Figures

METHOD AND APPARATUS FOR CONTROLLING COMPRESSORS

FIELD OF THE INVENTION

This invention generally relates to controls for compressors and more particularly to a novel and improved method and apparatus for closely controlling the operation of a compressor in relation to compressed air demand on the compressor.

BACKGROUND OF THE INVENTION

Generally, compressors are driven by some external prime mover such as an internal combustion engine or electric motor and supply compressed air to a receiver tank, from which the compressed air is drawn for usage by various pneumatic devices. Various compressor control apparatus has been proposed to regulate the output of the compressor, and the speed of the prime mover, in accordance with the demand for the compressed air. Generally, this control apparatus attempts to maintain the receiver tank pressure within a narrow range by loading and unloading the compressor and by regulating the speed of the prime mover, to match the demand for air. Small variations in pressure within the receiver tank are used to actuate valves which operate compressor unloading devices and motor speed devices.

Some prior art compressor control apparatus, such as those disclosed in U.S. Pat. Nos. 1,679,133, 1,906,012, 2,113,637, and 2,626,099, make no provision for utilizing the movement of one control member in one control circuit for automatically and simultaneously adjusting the speed of the prime mover and the functioning of the compression chambers. Nor is the prior art control apparatus arranged to bring in and take out compression chambers in succession one at a time to adjust compressor output in relation to air demands on the compressor to be able to operate the compressor efficiently at below-peak periods of air demand. Other prior art control apparatus utilize a first control circuit to operate the compressor unloading devices and a second control circuit to operate the driver speed devices. U.S. Pat. No. 2,585,168 is representative of this control apparatus. In control apparatus and systems of this type where two control circuits are utilized, cooperative interaction is required between the two circuits and independent settings and adjustments of either circuit are sometimes difficult to make.

Another prior art control system disclosed in U.S. Pat. No. 2,629,536 utilizes a speed control circuit that requires a governor to control the speed of the prime mover. This type of system is also difficult to adjust and requires additional costly components.

Accordingly, it is an object of the present invention to provide a simple, durable and efficient method and apparatus for controlling the operation of a compressor.

Another object of the present invention is to provide a novel and improved method and apparatus for controlling a compressor characterized by one control assembly responsive to air demand to adjust both speed and output capacity of the compressor to meet particular air demands with energy input to the compressor being closely matched to air demands so that proportionally less energy is required to operate the compressor during below-peak demand periods.

Yet another object of the present invention is to provide a novel and improved method and apparatus for controlling a compressor that provides a close regulation of receiver tank pressure over a wide range of compressed air demands.

A further object of the present invention is to provide a novel and improved method and apparatus for controlling a compressor having safety features whereby compressor output is rapidly decreased in the event of a gross air leakage and there is an automatic return of the apparatus to ambient pressure after a standard shutdown.

Still a further object of the present invention is to provide a novel and improved control assembly operatively associated with the speed control member of a prime mover with a plurality of compression chambers associated with the pressure-actuated unloader devices for the compression chambers with the movement of one directional control member simultaneously adjusting both the speed regulating member and a control valve, which in turn adjusts the unloader devices to successively bring in and take out one of a plurality of compression chambers one at a time in relation to compressed air demand on the compressor.

SUMMARY OF THE INVENTION

A method and apparatus for controlling a compressor operates to simultaneously adjust both the compressed air output and speed of the compressor in relation to compressed air demand on the compressor. The compressor apparatus shown is a reciprocating piston compressor with a plurality of separate compression chambers driven by a prime mover such as an engine or electric motor, each having an output controlled by an independent unloader device arranged to load the associated cylinder for maximum output from that chamber or unload the chamber for zero output from that cylinder. These unloader devices are selectively actuated by a sequential control valve in the control assembly to provide an incremental range of compressed air output between full output and zero output, according to demand.

The control assembly includes a single movable control member operatively coupled to move the speed regulating member and a plunger portion of the control valve to successively pressurize the unloader device and to move the plunger portion of an actuator responsive to tank pressures. The movable control member is moved in one direction to speed up the prime mover and successively enable more compression chambers to produce an output as the compressed air demand goes up and is resiliently urged by a resilient or bias member to move in the opposite direction to decrease the prime mover speed and successively take out compression chambers from a condition of producing an output as the compressed air demand goes down. A pressure regulator coupled between the tank and actuator enables increased tank pressure to gradually move the movable control member in one direction until a selected maximum tank pressure is reached, at which time the airflow through the regulator is nil and the resilient member moves the movable member in the other direction back to an at-rest position to slow down the prime mover to a minimum speed and remove all of the compression chambers from a condition of producing air output.

Other objects, advantages and capabilities of the present invention will become more apparent as the description proceeds, taken in conjunction with the accompanying drawings in which like parts have similar reference numerals and in which.

DESCRIPTION OF THE PREFERRED EMBODIMENTS

Figure 1:
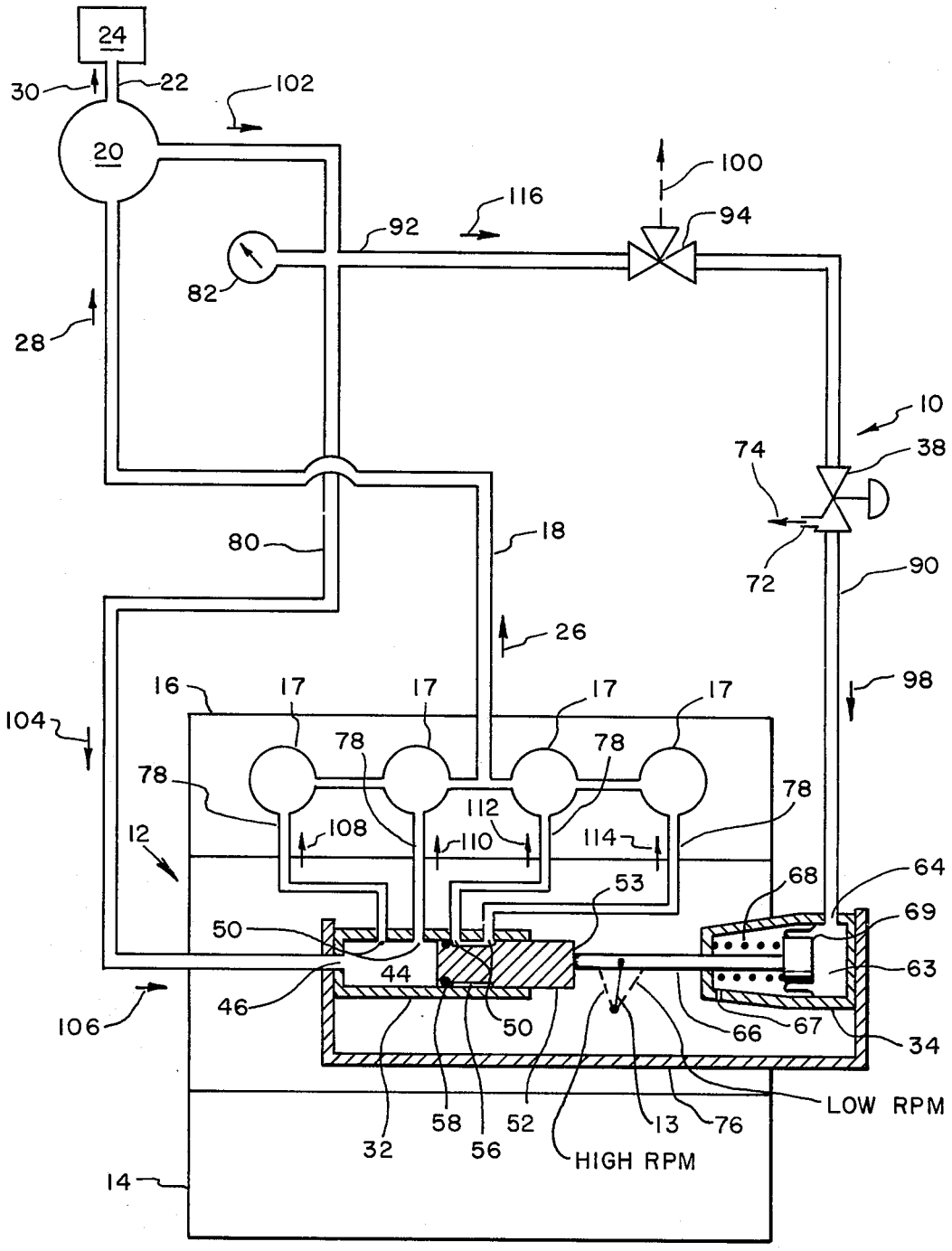
FIG. 1 is a diagrammatic view of a control apparatus with a cross-sectional view of the control assembly of the present invention.

Referring now to the drawings, in FIG. 1 control apparatus is generally designated 10. As shown, a compressor apparatus or unit generally designated 12 is illustrated as being a reciprocating, piston type compressor which may be similar to that described in U.S. Pat. No. 3,462,074. The prime mover for the compressor apparatus 12 shown includes a V-type spark ignition engine 14 having a speed regulating throttle 13 and having a compressor 16 with a plurality of compression chambers, mounted in place of one cylinder head on the engine block, to operate in conjunction with the engine cylinders on one side of the engine block. However, the driver/compressor system can be an in-line or other engine configuration or another type of power source physically separate from the reciprocating compressor 16 section.

The compressor 16 shown has four separate conventional pressure-actuated unloader devices, each represented by 17, and each associated with a compression chamber. The unloader devices 17 generally serve as an unloading means adapted to change the ability of the compressor to produce a compressed air output and specifically operate to stop delivery of compressed air from each compression chamber upon actuation by a preselected pressure and to cause the successive compression chambers to resume delivery or pumping of a compressed air output when an activating pressure is decreased to a preselected lower pressure value. The unloader devices 17 preferably are of the type described in the above-mentioned U.S. Pat. No. 3,462,074.

Although the control apparatus is herein described for usage with a V-type spark ignition engine, it is to be understood that the apparatus may be applied to reciprocating piston compressors powered by other sources, such as diesel cycle engines or electric motors. In addition, although the apparatus is illustrated with a four-cylinder compressor, it is equally applicable to other multi-chamber reciprocating piston compressors.

In the apparatus shown the compressed air delivery from compressor 16 is discharged through a common conduit 18 to a receiver tank 20 for storage. The compressed gas from the receiver tank 20 is discharged through a conduit 22 to one or more devices such as pneumatic tools schematically represented at 24. Arrows 26 and 28 indicate the direction of gas flow from the compressor 16 to the receiver tank 20 and arrow 30 indicates the direction of gas flow from the receiver tank 20 to the pneumatic devices 24.

The control apparatus 10 shown, generally stated, includes a control assembly having a movable control member 66, an air control valve 32 moved by member 66 for selectively operating the unloader valves 17 of the compressor 16, and an actuator 34 coupled to member 66 and operable by air pressure from the receiver tank 20 arranged for moving the air control valve 32, with the member 66 connected to speed regulating member 13 for varying the setting of member 13, which typically is the throttle control lever of the engine 14. A pressure regulator 38 is arranged for regulating air pressure to the actuator 34 based upon the air pressure level in the receiver tank 20.

Figure 3:
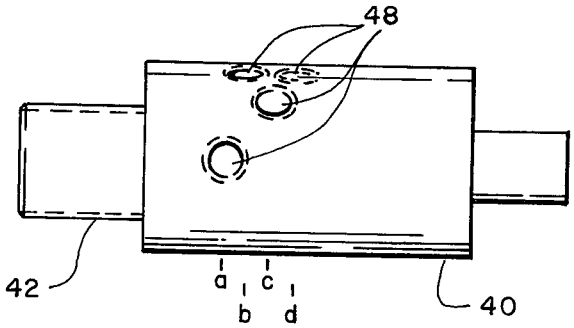
FIG. 3 is a top plan view of the control valve of FIG. 2.
Figure 4:
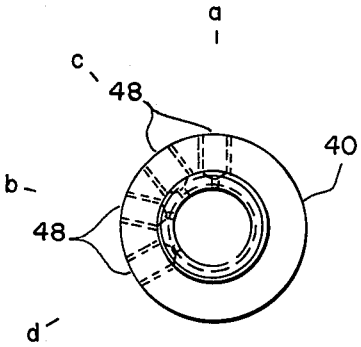
FIG. 4 is an end elevational view of the control valve of FIG. 2.
Figure 2:
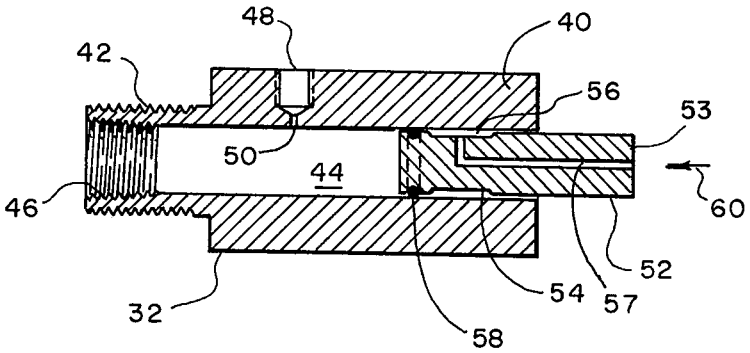
FIG. 2 is a cross section of one form of control valve for the apparatus of FIG. 1.

Referring to FIG. 2, air control valve 32 is shown in an enlarged cross-sectional view. In general, this valve 32 serves as an unloading operator responsive to the movement of the movable control member 66 to sequentially or successively actuate the compression chamber unloader devices. The air control valve 32 comprises a cylindrical housing 40 having an inside chamber or bore 44 with a reduced diameter, externally threaded end portion 42 for mounting purposes. A concentric chamber in the form of a bore 44 extends through the center of the housing 40 and has an internally tapped end portion 46 for connecting a conduit from the air control valve 32 to the receiver tank 20 for pressurizing the chamber 44 with receiver tank pressure. Four axially spaced tapped holes 48 in the housing 40 are provided for connecting conduits from the air control valve to the unloader devices 17 of the compressor 16. These holes 48 are staggered to one another both circumferentially and axially about the housing, as seen in FIGS. 3 and 4. Four small drilled ports 50 concentric with tapped holes 48 connect the tapped holes 48 with bore 44 of the air control valve 32.

The control valve 32 has a cylindrical plunger 52 with an outside diameter slightly less than the diameter of bore 44 of the housing 40 and is axially movably mounted within bore 44. The plunger 52 has a blunt end portion 53 and a reduced diameter portion 54 that forms an annular space 56 between the plunger 52 and the bore 44 of the housing 40. A hole portion is drilled through the center of the plunger 52 and an intersecting hole portion is drilled perpendicular to reduced diameter portion 54 to form an air vent hole 57 which connects the annular space 56 with the atmosphere. The plunger 52 has a seal 58 in a groove with the seal having an outside diameter slightly larger than the inside diameter of bore 44 of the housing 40, mounted in an annular groove at the inner end of the plunger 52. As will hereinafter be explained more fully, if the plunger 52 is moved axially inward into the bore 44 as indicated by arrow 60, the seal 58 will successively move past the four small drilled outlet ports 50 in the housing 40, successively isolating the ports and the compressor unloader valves 17 one at a time from receiver tank pressure in bore 44. As the plunger 52 moves axially inwardly, annular space 56 also successively contacts the outlet ports 50 and vents the pressure in the unloader devices 17 through air vent hole 57 to the atmosphere.

Figure 5:
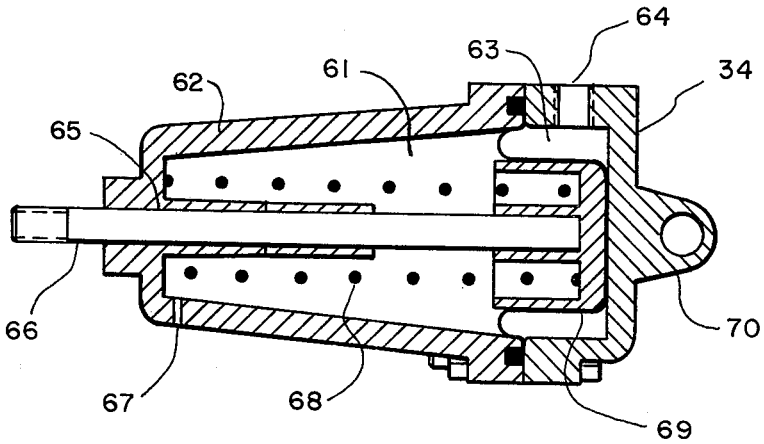
FIG. 5 is a cross section of an actuator for the apparatus of FIG. 1.

The actuator 34 shown in FIG. 5 is a conventional spring-return, diaphragm-type, air cylinder including a cylindrical housing 62 with a pressure chamber 63 having an internally threaded air inlet opening 64 for introducing compressed air into the chamber 63 for moving a plunger or diaphragm 69 in the chamber. The cylinder shown is equipped with a rod connected to the plunger 69 which serves as the single movable control member 66, which in turn serves to move speed regulating member 13. Control member 66 is reciprocally movable in a tubular guide 65 in housing 62. A spring 68 resiliently urges plunger 69 and control rod member 66 to the retracted position. Hole 67 vents cavity 61 to atmosphere. To extend the rod member 66 the pressure acting on the plunger 69 must exceed the spring force which progressively increases as the spring 68 is compressed. A clevis 70 is located at one end of the actuator cylinder 34 for mounting purposes.

Referring again to FIG. 1, the air control valve 32 and actuator 34 are shown mounted on a common base 76 opposite one another with their respective plungers and the movable control member 66 in coaxial alinement, the movable control member 66 being between plungers 52 and 69 and reciprocally movable back and forth conjointly therewith. The movement of member 66 in turn moves speed regulating member 13 between high and low rpm positions as indicated. The common base 76 is shown here for convenience. However, the air control valve 32 and actuator 34 may be mounted separately as well.

Referring to FIG. 1, a conventional pressure regulator 38 is designed to sense upstream pressure, i.e., receiver tank pressure, and to regulate downstream fluid flow as the upstream pressure approaches a selected maximum pressure cut-off level.

The pressure regulator 38 is adjustable so that the selected maximum pressure can be set as desired. When the upstream pressure approaches the selected maximum pressure level and the pressure regulator 38 reduces downstream flow, the upstream pressure must drop to some level below the selected maximum pressure before the flow is again increased. In the preferred form of the pressure regulator 38, a pressure drop of 2 psi below the selected maximum pressure will consistently reactivate the regulator flow.

The pressure regulator 38 has a small orifice 72 on the downstream side of the regulator that, when the regulator valve is open, allows a small stream of air to continuously flow as indicated by arrow 74. The orifice 72 functions to reduce downstream pressure by bleeding off downstream air.

In the apparatus shown in FIG. 1 four conduits 78 connect each of the unloader devices 17 to a corresponding port 50 on the air control valve 32. Another conduit 80 connects the receiver tank 20 to opening 46 of the air control valve 32 pressurizing interior bore 44 of the air control valve 32 and tending to bias the plunger 52 for opening the air control valve 32. A pressure gauge 82 is mounted to conduit 80 to read the pressure in the conduit 80 and the receiver tank 20.

The actuator 34, being mounted in coaxial alinement with the air control valve 32 on base 76, is such that when the member 66 is actuated the member moves the end 53 of the air control valve plunger 52 for axially inwardly moving the air control valve plunger 52 into bore 44 of the air control valve 32 for moving the plunger 52 of the air control valve 32.

The air inlet 64 of actuator 34 is connected by a conduit 90 to the pressure regulator 38 which is connected by another conduit 92 to the receiver tank 20. A two-position, three-port valve 94 is located in conduit 92 between the pressure regulator 38 and the receiver 20. The valve 94 may be shifted to an on or "run" position in which conduit 90 between the pressure regulator 38 and the actuator cylinder 34 is open for directing airflow from the pressure regulator 38 to the actuator cylinder 34 as indicated by arrow 98. The valve 94 may also be shifted to an off or "start" position in which conduit 90 to the pressure regulator 38 and actuator cylinder 34 is closed off. In the "start" position air from the actuator 34 may also vent through an opening in the valve 94 as indicated by dotted arrow 100.

OPERATION

Prior to start-up the apparatus is normally at ambient pressure. To begin the cycle of operation the two-position valve 94 should be in an off or "start" position when the driver 14 is started. Prior to and immediately after starting, the speed regulating throttle 13 of the engine is held in the low rpm position by the actuator 34, which is biased in its retracted position by its spring 68. As the engine continues to run, the output of the compressor 16 begins to build up pressure in the receiver tank 20 and air flows as indicated by arrows 102, 104 and 106 from the receiver tank 20 into bore 44 of the air control valve 32, pressurizing the bore 44. The pressure in bore 44 acts on the plunger 52 of the air control valve 32, ensuring that the end 53 of the plunger 52 abuts the control member.

With the plunger 52 in its extended position, all of the ports 50 of the air control valve 32 are exposed to receiver tank air pressure in bore 44, and the air flows through conduits 78 as indicated by arrows 108, 110, 112, 114 into the unloader devices 17 of the compressor 16, pressurizing the unloader devices 17. When the pressure in the receiver tank 20 reaches the actuation pressure of the unloader devices, as for example 30 psi, the unloader devices 17 are actuated and unload the compression chambers of the compressor 16. The system is now at an "idle" condition and the two-position, three-port valve 94 is manually switched to its on or "run" position, allowing air to flow from the receiver tank 20 through pressure regulator 38 and to the actuator 34, as indicated by arrows 102, 116, 98.

The air pressure within the housing cavity 63 of actuator 34 acting on the plunger or diaphragm 69 of the actuator causes the control member 66 to move slowly from an at-rest minimum compressor speed position toward a maximum compressor speed position. As the member 66 gradually extends, the speed control throttle 13 is moved from the low rpm setting and the engine speed is gradually increased. The movement of the member 66 also moves the air control valve plunger 52 so that the plunger 52 is moved axially inward in bore 44 of the air control valve 32. The actuator valve 34 and air control valve 32 are sized such that the forces acting on the plunger 52 will tend to move the plunger 52 axially inward at a slow rate.

As the plunger 52 moves axially inward the seal 58 near the end of the plunger moves across the small ports 50 in the control valve 32. Once the seal 58 has moved axially inward past a port 50 the port 50 is sealed off from receiver tank air pressure in bore 44. As the plunger continues to move axially inward, annular space 56 behind the seal also moves across the ports. When the annular space 56 is in front of a port 50 the corresponding unloader device 17 is vented through air vent 57 (FIG. 2) in the plunger 52 to the atmosphere. Once an unloader device 17 is vented the corresponding compression cylinder of the compressor is loaded and begins delivery of compressed air to the receiver tank 20.

The actuator member 66 continues to extend until the engine throttle 13 has reached the high rpm setting and the air control valve plunger 52 has moved past all of the ports 50 and loaded all of the compression cylinders of the compressor 16. With all compressor cylinders loaded, the pressure in receiver tank 20 soon reaches the selected maximum pressure of the pressure regulator 38, as for example 100 psi, and this causes the pressure regulator 38 to cut off airflow from the receiver tank 20 to the actuator cylinder 34. The pressure in the actuator 34 is then quickly vented through orifice 72 of the pressure regulator 38 and spring 68 of the actuator cylinder 34 moves control member 66 back to the at-rest position, accompanied by the movement of the engine throttle lever 13 to the low rpm position.

As control member 66 moves to the at-rest position, receiver air pressure in bore 44 of the air control valve 32 moves the plunger 52 axially outward again toward the extended position and the end 53 of the plunger follows the end of member 66. With the plunger 52 in this position, all of the ports 50 of the control valve 32 are exposed to receiver tank pressure and the unloader valves 17 are pressurized. This unloads all of the compression chambers of the compressor 16. The system is now at its operating pressure, as for example at 100 psi, and the pneumatic devices 24 may be activated.

As the pneumatic devices begin to use air the pressure in the receiver tank drops. A small pressure drop, as for example 2 psi, in the receiver tank pressure will now cause the pressure regulator 38 to open, allowing air to flow through the regulator 38 to pressurize actuator 34. The control member 66 will again extend or move away from the at-rest position, moving throttle 13 to increase the speed of the engine, and moving plunger 52 of the air controller valve for progressively loading the compression chambers as previously explained.

If the demand is such that only one compression chamber needs to be loaded to meet the demand, the receiver tank pressure will quickly rise to the selected maximum or cut-off pressure of 100 psi before another compression chamber is loaded by the movement of the plunger 52, and the pressure regulator 38 will reduce airflow to the actuator 34. The actuator cavity 63 will then be vented through orifice 74 and spring 68 will move the control member 66, lowering the driver and compressor speed and allowing the plunger 53 to move to unload the loaded compression chamber.

If the demand is such that the output of more than one compression chamber is required, the pressure in the receiver tank will not reach the cut-off pressure of the pressure regulator 38, and the compression chamber will continue to be loaded by the action of the plunger 52 and the engine speed will be continuously increased until the demand is met.

Accordingly, as the pressure in the receiver tank reaches the selected maximum pressure of the pressure regulator 38, the airflow to the actuator 34 is reduced and pressure in the actuator 34 is reduced. The control member 66 and the engine throttle lever 13 are held in a low rpm or minimum operating position with all of the compression chambers of the compressor 16 not pumping or unloaded.

If the receiver tank pressure falls to some selected pressure level below the selected maximum pressure, as for example 2 psi below, the pressure regulator 38 will open, causing the control member 66 to gradually move to increase the speed of the engine and causing the air control valve plunger 52 to successively load the compression chambers of the compressor 16 one at a time until the receiver tank pressure is again brought up to the selected maximum or cut-off pressure of, for example, 100 psi, at which time the cycle is repeated.

The receiver tank pressure is thus maintained within a narrow pressure range of, for example, 98 to 100 psi and the compression chambers produce or are loaded only as needed to match the compressed air demand. The engine speed is closely related or matched to the loading of the compressor cylinders for conserving energy, as described hereinafter with reference to FIG. 7.

For shutting down the system the two-position valve 94 is normally shifted to an off or "start" position, which also vents air in the actuator 34 through the two-position valve 94, as indicated by arrow 100. After a finite "cool-down" period, the driver engine may be stopped.

Figure 6:
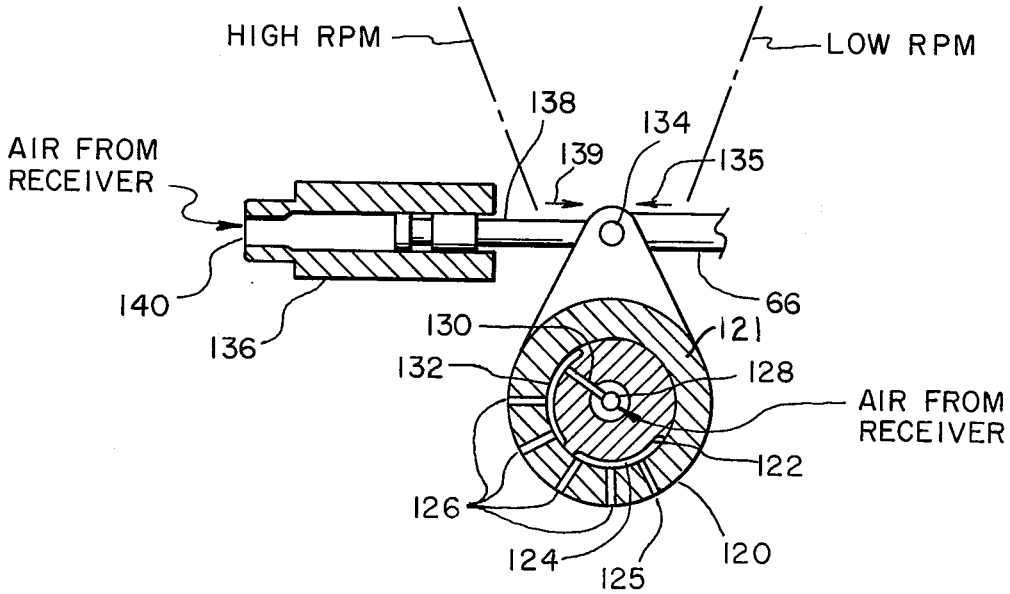
FIG. 6 is a cross section of a portion of a compressor control apparatus utilizing a rotary form of control valve.

Referring now to FIG. 6, there is shown an alternate embodiment of the air control valve in the form of a rotary air control valve 120 having a cylindrical valve body 121 containing a cylindrical spool 122 fixedly mounted in relation to the rotatively movable valve body 121. The valve body 121 has an air vent port 125 and a series of four ports 126 that are connected by conduits to the four unloader valves 17 of the compressor and function in the same manner as ports 50 of the air control valve 32. The center of the valve spool 122 has a recess 128 which may be connected through a conduit to the receiver tank 20. A radial passage 130 in the valve spool 122 connects an annular recess 132 formed between the valve spool 122 and the valve body 121 with recess 128, for exposing the annular recess 132 to receiver tank pressure. A second annular recess 124 in valve spool 122 is located to provide a connecting passage between vent 125 and unloader ports 126 with specific rotation of valve body 121.

The valve body 121 is connected to a pin 134 which can be pushed for rotating the body 121 of the rotational air control valve 120 with respect to the valve spool 122 for moving ports 126 into and out of contact with annular recesses 132 and 124.

For operating the rotational air control valve 120, the actuator is mounted with its control member 66 in position to push on pin 134 of the rotational air control valve 120, as represented by arrow 135. A control cylinder 136 having a plunger member 138 is mounted in axial alinement with member 66 such that its plunger 138 may push on pin 134 of the rotational air control valve 120 in a direction opposite to member 66, as indicated by arrow 139. The control cylinder 136 is nearly of the same construction as the air control cylinder 32 shown in FIGS. 1 and 2 but does not have ports 50 for connecting the unloader valves 17 to receiver tank air pressure. On control cylinder 136 a conduit connects the interior of the cylinder 140 to receiver tank air pressure for axially outwardly moving plunger member 138 for pushing on pin 134 of the air controller valve 120. The functions of control cylinder 136 assist the movement of plunger member 66. However, the compression strength of spring 68 of actuator 34 may be increased to eliminate the need for control valve 136.

With the rotational air control valve 120 used in place of air control valve 32, the control apparatus 10 functions in the same manner as previously explained. In the low rpm position of the rotational control valve 120, all of the ports 126 on the valve body 121 will be alined with annular recess 132, so that the unloader valves 17 will be exposed to receiver tank 20 air pressure. When the actuator member 66 is extended, the engine rpms are increased by the control member and ports 126 are successively rotated out of alinement with annular recess 132 and are vented through annular passage 124 between the valve spool 122 and valve body 121 and out air vent port 125 to the atmosphere for loading the compression chambers. In the high rpm position of rotational air control valve 120, all of the ports 126 are so vented for loading all of the compression chambers of the compressor 16.

Figure 7:
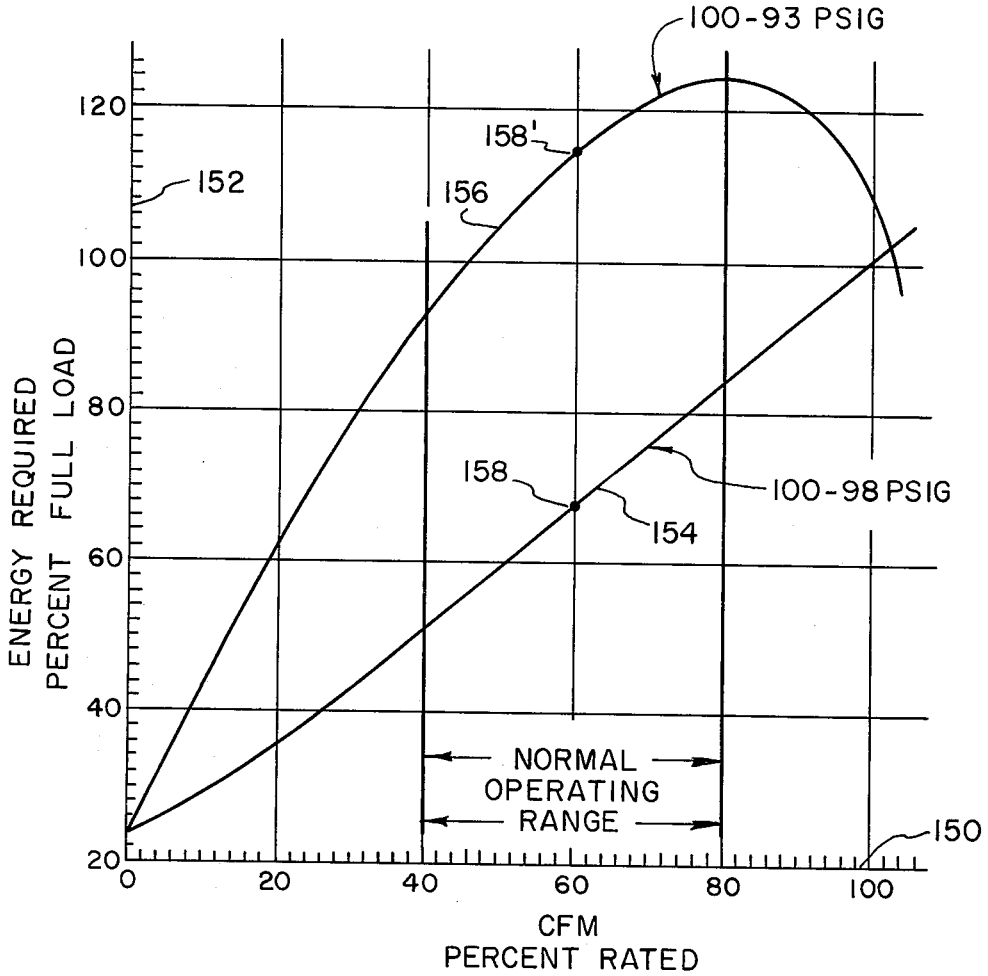
FIG. 7 is a chart typifying the compressed air output versus the energy requirements of a compressor utilizing the compressor control apparatus of the present invention.

Referring now to FIG. 7, the operating characteristics of compressor apparatus utilizing the control apparatus 10 are shown in comparison to a compressor utilizing presently available control apparatus. The abscissas 150 of the graph represents the cubic feet per minute output of the compressor as a percentage of the full output rating of the compressor. The ordinate 152 of the graph represents the energy being utilized by the compressor expressed as a percentage of energy consumed at the full load rating of the compressor engine. Line 154 represents the performance of the compressor with an output pressure of 98–100 psig using the control apparatus of the present invention. Line 156 represents the approximate performance of the present conventional prior art controlled compressor with an output pressure of 93–100 psig.

As shown in FIG. 7, the relationship of energy input to air output of a compressor controlled with the present invention is almost linear. In addition, the graph shows that energy consumption is more directly related or matched to the compressor output when the control apparatus of the present invention is utilized but is not as closely matched with the prior art control apparatus. For example, as point 158 on line 154 representing a compressor, with the present control system the compressor is operating at 60% of its maximum rating and the engine at approximately 67% of its maximum fuel consumption. In comparison, point 158' on line 156 represents the performance of a conventionally controlled compressor and, as shown, with an output of 60% of the compressor maximum rating its driver engine is consuming energy at approximately 115% of that required for maximum output. This large disparity between the operation of the engine and the output of the compressor indicates that with prior art control apparatus a large amount of energy is being wasted. In fact, all of the area bounded by lines 156 and 154 represents additional energy being consumed by prior art controls over a compressor controlled by the control apparatus of the present invention.

From the foregoing it should be apparent that the control apparatus above described automatically matches compressor output more closely with demand and prime mover speed with compressor loading and returns the system to a minimum speed, minimum power input operating condition when there is no demand on the compressor.

The control apparatus of the present invention operates in response to compressed air demand to simultaneously set both an output control mechanism controlling the compressor air pumping and the speed control for the compressor. There are essentially two extremes of conditions or modes. First there is minimum speed, minimum output at zero or minimum compressed air demand, and second there is maximum speed, maximum output, and maximum compressed air demand.

Between these two modes, as the compressed air demand goes up a single control member is used to simultaneously move both the compression chamber control members and the speed regulating member to successively bring in more pumping chambers and increase the speed to meet demand requirements and, conversely, as the demand goes down, pumping chambers are taken out and the speed is reduced. The sequence for taking out the ability of the compression chambers to produce an output with respect to holes 48 as plunger 52 is moved from left to right, as shown in FIGS. 2–4, is designated d, c, b, and a. Conversely, the sequence for bringing these chambers in is a, b, c, and d as the plunger is moved to the left. Four unloading-/loading step sequences are illustrated herein, but the concept is applicable to any plurality of compression chambers.

The advantage of this approach is that the energy or power input to drive the compressor is more closely matched to air demand requirements. If the demand is less, fewer pumping chambers are used, their output is lowered due to reduced speed, and less power input is required. The curve of FIG. 7 illustrates that in a system of this type there approaches a proportional relationship between compressor output and power input. As more chambers produce compressed air, the compressor output approaches 100% capacity and the engine requires more power input, but as the compression chambers are taken out less power input is required. For this reason it can be said that the control system of the present invention operates at better efficiency or less energy input during below-peak periods of air demands.

It is understood that, while elements 32, 34, 38, 68 and 69 are illustrated as separate parts interconnected to one another, their functions may be performed by one integral unit. It is further understood that a device embodying the present invention may control two or more compressors in service and that these compressors do not necessarily need to be of the piston or reciprocating type but could be of the screw, vane or other known types. It is further understood that individual loading and unloading of the cylinders can be accomplished with separate pilot valves for each cylinder working in conjunction with a speed control.

Although the present invention has been described with a certain degree of particularity, it is understood that the present disclosure has been made by way of example and that changes in details of structure may be made without departing from the spirit thereof.

What is claimed is:

1. Control apparatus for a compressor having at least two compression chambers, each with a compressed air output proportional to compressor speed, said chambers being arranged in a parallel feeding relation to a common delivery conduit which receives airflow from one chamber independently of the pumping operation of the other chamber, unloading means operable on said chambers to selectively bring in said chambers one at a time for pumping and take out said chambers one at a time from pumping and a variable speed prime mover driving said compressor having a speed regulating member adapted to change the speed of the compressor, said control apparatus comprising:

control means responsive to compressed air demand on said compressor including a movable control member arranged for simultaneously adjusting both said unloading means and said speed regulating member in relation to air pressure demand on the compressor in increments over a range of compressor speeds at and between two different selected speed settings and in increments over a range of air pressure demands, the air flow rate in said common delivery conduit being changed by bringing in for pumping or taking out from pumping selected of said compression chambers at a selected compressor speed, said control and speed regulating members being varied so that as the demand increases the compressor speed and the number of chambers pumping are simultaneously increased to increase compressed air output from said compressor and as the demand decreases the compressor speed and the number of chambers pumping are simultaneously decreased to decrease compressed air output from said compressor over said ranges of compressor speed and air pressure demand, said movable control member being arranged to automatically return to a position establishing a minimum operating condition of minimum speed and minimum power input for the compressor when there is essentially no demand on said compressor.

2. Control apparatus as defined in claim 1 wherein said control means includes an actuator responsive to compressed air demand coupled to said movable control member to move said movable control member in relation to compressed air demand.

3. Control apparatus as defined in claim 2 wherein said actuator portion has a bias member arranged to return said movable control member to said position establishing said minimum operating condition when there is essentially no demand on said compressor.

4. Control apparatus for compressor apparatus including a compressor having at least two compression chambers, each with a compressed air output proportional to compressor speed, said chambers being arranged in a parallel feeding relation to a common delivery conduit which receives airflow from one chamber independently of the pumping operation of the other chamber, unloading means operable on said chambers to selectively being in said chambers one at a time for pumping and take out said chambers one at a time from pumping, a variable speed prime mover driving said compressor having a speed regulating member, and a tank into which compressed air is pumped from said compressor, said control apparatus comprising:

a control member coupled to said speed regulating member movable between a first position corresponding to minimum compressor speed and a second position corresponding to maximum compressor speed;

an actuator having a first housing with a first chamber pressurized by said tank pressure and a first plunger in said first chamber coupled to said control member for moving said speed regulating member to increase compressor speed as the tank pressure increases and a bias member to resiliently urge said first plunger in opposition to the pressure in said first chamber; and a control valve coupled to said unloading means having a second housing with a second chamber pressurized by said tank pressure and a second plunger in said second chamber moved by said control member simultaneously with said first plunger for successively bringing in for pumping each compression one at a time and increasing compressor speed to produce an increased compressed air output as the tank pressure increases and successively removing from pumping each compressor chamber one at a time and decreasing compressor speed for producing a decreased compressed air output as the tank pressure approaches a preset limit in increments over a range of compressor speeds at and between two different selected speed settings and in increments over a range of air pressure demands, the air flow rate in said common delivery conduit being changed by bringing in for pumping or taking out from pumping selected of said compression chambers at a selected compressor speed, said control and speed regulating members being varied so that as the demand increases the compressor speed and the number of chambers pumping are simultaneously increased to increase compressed air output from said compressor and as demand decreases the compressor speed and the number of chambers pumping are simultaneously decreased to decrease compressed air output from said compressor over said ranges of compressor speed and air pressure demand, said control member being automatically returned by said bias member to said first position when there is essentially no demand on said compressor.

5. Control apparatus as set forth in claim 4 wherein said control member, actuator, and control valve are supported in a fixed relation to each other with said control member and said first and second plungers coupled between said control member and arranged in coaxial alinement with one another.

6. Control apparatus for a reciprocating piston compressor powered by a variable speed prime mover with a speed regulating member and having at least two compression chambers each with a compressed air output proportional to compressor speed, said chambers being arranged in a parallel feeding relation to a common delivery conduit which receives airflow from one chamber independently of the pumping operation of the other chamber, an unloader device operable on said chambers to selectively bring in said chambers one at a time for pumping and take out said chambers one at a time from pumping for regulating the output of the compressor to a tank coupled between the compressor and at least one pneumatic device, said apparatus comprising:

valve means for pressurizing said unloader devices and for venting said unloader devices for unloading and loading said compression chambers, respectively, for bringing in and taking out said chambers for varying the compressed air output of said compressor;

actuator means including a movable control member for moving the valve means for selectively pressurizing and venting the unloader devices and also for moving the speed regulating member of the prime mover for varying the prime mover speed simultaneously with the movement of said control member in increments over a range of compressor speeds at and between two different selected speed settings and in increments over a range of air pressure demands, the air flow rate in said common delivery conduit being changed by bringing in for pumping or taking out from pumping selected of said compression chambers at a selected compressor speed; and pressure regulator means for moving said actuator means when the receiver tank pressure is below a selected minimum value to simultaneously increase the prime mover speed and move said valve means for selectively venting said unloader devices to increase the number of chambers pumping for increasing the output of the compressor, and for moving the actuator means when the tank pressure reaches the selected maximum value to simultaneously move said speed regulating member to slow down the prime mover speed and to move said valve means for pressurizing said unloader devices to decrease the number of chambers pumping for decreasing the output of said compressor.

7. Control apparatus as defined in claim 6 wherein said movable control member is resiliently urged to direct compressed air from said tank to said unloader devices and movable for incrementally venting said unloader devices.

8. Control apparatus as defined in claim 7 wherein said actuator means includes a spring return air cylinder having a housing and a plunger in the housing linked to said speed regulating member of the prime mover and movable by air pressure from said tank for moving said speed control member and for moving said movable air control member.

9. Control apparatus as defined in claim 8 wherein said pressure regulator means includes a pressure regulator for controlling compressed air pressure from said tank to said actuator cylinder for moving the actuator cylinder in one direction when the tank pressure is below said selected minimum value and for reducing said actuator cylinder pressure for moving the actuator cylinder in the opposite direction when the receiver tank pressure reaches the selected maximum value.

10. Control apparatus for a compressor powered by a variable speed prime mover with a speed regulating member and having at least two compression chambers, each with a compressed air output proportional to compressor speed, said chambers being arranged in a parallel feeding relation to a common delivery conduit which receives airflow from one chamber independently of the pumping operation of the other chamber, a pressure actuator unloader device associated with each compression chamber for selectively bringing in said chambers one at a time for pumping and taking out said chambers one at a time from pumping for regulating the output of said compressor to a receiver tank coupled with said compressor and at least one pneumatic device coupled to said receiver tank, said control apparatus comprising:

valve means for directing compressed air from said receiver tank to said unloader devices for pressurizing said unloader devices for unloading said compression chambers and movable for successively venting the unloader devices for loading the compression chambers;

actuator means including a movable control member normally biased to hold said spped regulating member at a minimum speed position and said valve means for pressurizing all of said unloader devices to take out from pumping all of said chambers and movable by air pressure from said receiver tank in increments over a range of compressor speeds at and between two different selected speed settings and in increments over a range of air pressure demands for gradually moving said speed regulating member for gradually speeding up the prime mover and simultaneously with said speed increase, gradually moving said valve means for successively venting said unloader devices for successively loading and thereby bringing in said compression chambers one at a time for pumping, the air flow rate in said common delivery conduit being changed by bringing in for pumping or taking out from pumping selected of said compression chambers at a selected compressor speed; and pressure regulator means for directing airflow from said receiver tank to said actuator means for gradually moving said actuator means, when the air pressure in the receiver tank is below a selected value, and for reduction of airflow from the receiver tank to said actuator means and venting said actuator means when said receiver tank pressure is at said selected value;

whereby at a receiver tank pressure of said selected value said prime mover is at minimum speed and all of the compression chambers are unloaded and at a receiver tank pressure below said selected value the compression chambers are successively loaded and the prime mover speed is increased until the selected pressure value in the receiver tank is reached.

11. Control apparatus as defined in claim 10 wherein said valve means includes an air control valve normally biased by air pressure from said receiver tank to pressurize said unloader devices and movable by said actuator means to selectively vent said unloader devices.

12. Control apparatus as defined in claim 10 wherein said actuator means includes a spring return air cylinder with a housing and a movable plunger coupled to the speed regulating member of the prime mover and positioned to move said valve means.

13. Control apparatus as defined in claim 10 wherein said pressure regulator means includes a pressure regulator coupled between said receiver tank and said actuator means.

14. Control apparatus as defined in claim 10 wherein said actuator means includes a spring return air cylinder having a housing and a plunger movable in said housing, said housing coupled to said receiver tank which pressure moves said plunger linked to a speed regulating member of said prime mover.

15. Control apparatus as defined in claim 14 wherein said pressure regulator means includes a pressure regulator coupled between said receiver tank and said housing for directing compressed air from said receiver tank to said housing for moving said plunger in said housing in one direction when the receiver tank pressure is below a selected value and for venting said actuator cavity pressure for moving said plunger in said air cylinder in the opposite direction when the receiver tank pressure reaches a selected value.

16. A control valve for compressor apparatus including at least two compression chambers, each with a compressed air output proportional to compressor speed, unloader devices operable on said chambers to selectively bring in said chambers one at a time for pumping and take out said chambers one at a time from pumping by selectively venting and directing compressed air from a receiver tank to each of said unloader devices, and a variable speed prime mover driving said compressor having a speed regulating member comprising:

a housing having an interior chamber with an inlet for receiving air pressure for pressurizing the interior chamber and having a plurality of outlet ports in communication with the interior chamber with each port being adapted for connection to an unloader device of a compressor for pressurizing unloader devices; and plunger means axially movable within said interior chamber in response to the movement of said speed regulating member in increments over a range of compressor speeds at and between two different selected speed settings and in increments over a range of air pressure demands, said plunger means arranged for successively sealing said ports from said interior chamber, and a vent hole extending through the interior thereof for selectively venting pressure at said ports to the atmosphere in relation to the axial position of said plunger means in said housing.

17. A control valve as defined in claim 16 wherein said plunger means includes a plunger having a seal mounted in a groove near one end of said plunger for successively sealing said ports from said interior chamber.

18. A method for controlling a compressor with at least two compression chambers, each with a compressed air output proportional to compressor speed, said chambers being arranged in a parallel feeding relation to a common delivery conduit which receives airflow from one chamber independently of the pumping operation of the other chamber, unloading means operable on said chambers to selectively bring in said chambers one at a time for pumping and take out said chambers one at a time for pumping and take out said chambers one at a time from pumping, and a variable speed prime mover driving said compressor with a speed regulating member adapted to change the speed of the compressor comprising the steps of:

simultaneously setting both said unloading means and said speed regulating member in relation to compressed air demand on the compressor in increments over a range of compressor speeds at and between two different selected speed settings and in increments over a range of air pressure demands, the air flow rate in said common delivery conduit being changed by bringing in for pumping or taking out from pumping selected of said compression chambers at a selected compressor speed, said control and speed regulating members being varied so that as the demand increases the compressor speed and the number of chambers pumping are simultaneously increased to increase compressed air output from said compressor and as the demand decreases the compressor speed and the number of chambers pumping are simultaneously decreased to decrease compressed air output from said compressor over said ranges of compressor speed and air pressure demand with said compressor being automatically returned to a minimum operating condition of minimum speed and minimum power input when there is essentially no demand on said compressor.

19. A method of controlling the compressed air output and speed of a reciprocating piston compressor having at least two compression chambers, each with a compressed air output porportional to compressor speed, said chambers being arranged in a parallel feeding relation to a common delivery conduit which receives airflow from one chamber independently of the pumping operation of the other chamber, a prime mover with a speed regulating member and an unloader device operable on said chambers to selectively bring in said chambers one at a time for pumping and take out said chambers one at a time from pumping for regulating compressed air delivery of said chambers comprising the steps of:

pressurizing a tank with compressed air from said compressor;

sensing the air pressure in said tank;

directing compressed air from said tank to the unloader devices to pressurize the unloader devices and unload said compression chambers when the tank pressure reaches a selected value;

incrementally venting said unloader devices one at a time when said tank pressure is below a selected value to incrementally load said compression chambers one at a time until said tank pressure is brought up to the selected value, the air flow rate in said common delivery conduit being changed by bringing in for pumping or taking out from pumping selected of said compression chambers at a selected compressor speed; and moving said speed regulating member of said prime mover to speed up said prime mover to increase the output of each chamber while said compression chambers are being incrementally loaded to increase compressed air output from said compressor, and to slow down said prime mover at the same time said compression chambers are unloaded to decrease compressed air output from said compressor, said speed regulating member being moved in increments over a range of compressor speeds at and between two different selected speed settings and in increments over a range of air pressure demands.

20. Control apparatus for a compressor powered by a variable speed prime mover with a speed regulating member and having at least two compression chambers with a pressure actuated unloader device associated with each compression chamber for regulating the output of said compressor to a receiver tank coupled with said compressor and at least one pneumatic device, said control apparatus comprising:

valve means for directing compressed air from said receiver tank to said unloader devices for pressurizing said unloader devices for unloading said compression chambers and movable for successively venting the unloader devices for loading the compression chambers;

actuator means including a movable control member normally biased to hold said speed regulating member at a minimum speed position and said valve means for pressurizing all of said unloader devices and movable by air pressure from said receiver tank for gradually moving said speed regulating member of said driver for gradually speeding up the prime mover, and for gradually moving said valve means for venting said unloader devices for successively loading said compression chambers;

pressure regulator means for directing airflow from said receiver tank to said actuator means for gradually moving said actuator means, when the air pressure in the receiver tank is below a selected value, and for reduction of airflow from the receiver tank to said actuator means and venting said actuator means when said receiver tank pressure is at said selected value.

whereby at a receiver tank pressure of said selected value said prime mover is at minimum speed and all of the compression chambers are unloaded and at a receiver tank pressure below said selected value the compression chambers are successively loaded and the prime mover speed is increased until the selected pressure value in the receiver tank is reached, said valve means including an air control valve normally biased by air pressure from said receiver tank to pressurized said unloader devices and movable by said actuator means to selectively vent said unloader devices;

a housing having a circular interior bore connected by a first conduit to said receiver tank for pressurizing the interior bore with receiver tank pressure, said housing having a plurality of axially and circumferentially spaced output ports in communication with said interior bore with each port connected to a conduit to one of said unloader devices; and a plunger member axially movable within said bore and having a seal mounted near one end in a groove and a vent hole to atmosphere adjacent to said seal, such that the plunger member may be moved through said bore for selectively sealing the ports and unloader devices from receiver tank pressure in the bore and for venting the ports and the unloader devices through the vent hole to the atmosphere.

21. Control apparatus for a compressor powered by a variable speed prime mover with a speed regulating member and having at least two compression chambers with a pressure actuated unloader device associated with each compression chamber for regulating the output of said compressor to a receiver tank coupled with said compressor and at least one pneumatic device, said control apparatus comprising:

valve means for directing compressed air from said receiver tank to said unloader devices for pressurizing said unloader devices for unloading said compression chambers and movable for successively venting the unloader devices for loading the compression chambers;

actuator means including a movable control member normally biased to hold said speed regulating member at a minimum speed position and said valve means for pressurizing all of said unloader devices and movable by air pressure from said receiver tank for gradually moving said speed regulating member of said driver for gradually speeding up the prime mover, and for gradually moving said valve means for venting said unloader devices for successively loading said compression chambers;

pressure regulator means for directing airflow from said receiver tank to said actuator means for gradually moving said actuator means, when the air pressure in the receiver tank is below a selected value, and for reduction of airflow from the receiver tank to said actuator means and venting said actuator means when said receiver tank pressure is at said selected value, whereby at a receiver tank pressure of said selected value said prime mover is at minimum speed and all of the compression chambers are unloaded and at a receiver tank pressure below said selected value the compression chambers are successively loaded and the prime mover speed is increased until the selected pressure value in the receiver tank is reached, said valve means including an air control valve normally biased by air pressure from said receiver tank to pressurize said unloader devices and movable by said actuator means to selectively vent said unloader devices, said valve means including a circular valve spool member having an interior recess connected by a first conduit to said receiver tank for pressurizing said recess with receiver tank pressure;

a valve body member mounted circumjacent to said valve spool for relative rotational movement with respect to said valve spool and having an air vent hole to the atmosphere and a plurality of ports with each port connected by a conduit to one of said unloader devices; and an annular recess formed between said valve body and said valve spool in communication with the interior recess of said valve spool and normally in alinement with said ports in said valve body for pressurizing the unloader devices and rotatable with said valve body member for selectively moving said annular recess out of alinement with said ports for venting the pressure in said ports and said unloader devices out of said air vent hole to the atmosphere.

* * * * *